US005571291A

United States Patent [19]

Koike

[11] Patent Number: 5,571,291

[45] Date of Patent: Nov. 5, 1996

[54] LOW-TEMPERATURE DYEING ADDITIVE FOR PROTEIN FIBER PRODUCTS AND DYEING METHOD USING THE SAME

[75] Inventor: Sachizumi Koike, Aichi, Japan

[73] Assignee: Tuyaku Co., Ltd., Aichi, Japan

[21] Appl. No.: 481,316

[22] PCT Filed: Jul. 29, 1994

[86] PCT No.: PCT/JP94/01259

§ 371 Date: Jul. 5, 1995

§ 102(e) Date: Jul. 5, 1995

[87] PCT Pub. No.: WO95/12707

PCT Pub. Date: May 11, 1995

[30] Foreign Application Priority Data

Nov. 5, 1993 [JP] Japan ..... 5-276499

[51] Int. Cl.[6] ..... D06P 5/00; D06P 3/06; D06P 3/16; D06P 1/90

[52] U.S. Cl. ..... 8/564; 8/565; 8/568; 8/574; 8/584; 8/587; 8/586; 8/614; 8/602; 8/917

[58] Field of Search ..... 8/564, 565, 568, 8/574, 584, 586, 587, 602, 614, 631, 917, 916, 130.1, 542, 492, 930, 127.5, 127.6, 128.1, 128.3; 106/20 D

[56] References Cited

U.S. PATENT DOCUMENTS

| | | | |
|---|---|---|---|
| 4,063,877 | 12/1977 | Elliot et al. | 8/930 X |
| 4,695,846 | 9/1987 | Suzuki | 346/1.1 |
| 4,802,887 | 2/1989 | Ateya | 8/524 |
| 4,990,186 | 2/1991 | Jones et al. | 106/22 |
| 5,316,575 | 5/1994 | Lent et al. | 106/20 R |
| 5,435,807 | 7/1995 | Kuhn | 8/490 |

FOREIGN PATENT DOCUMENTS

| | | |
|---|---|---|
| 746643 | 7/1970 | Belgium . |
| 2653418 | 1/1978 | Germany . |
| 52-059782 | 5/1977 | Japan . |
| 60-173187 | 9/1988 | Japan . |

*Primary Examiner*—Margaret Einsmann
*Attorney, Agent, or Firm*—McAulay Fisher Nissen Goldberg & Kiel, LLP

[57] ABSTRACT

A low-temperature dyeing additive for protein fiber products contains one or more kinds of solvents which are freely miscible with water and having a donor number within the range of 24 to 50 and an acceptor number within the range of 10 to 24 in the presence or absence of a surfactant, in an amount of 0.025 to 40 g per liter of water, has a pH of 3.5 to 9.5. If necessary, it contains tributoxyethyl phosphate in an amount of 0.025 to 4.0 g per liter of water, and/or contains one or more kinds of anions having an enthalpy of hydration ($-\Delta H_{KJ \cdot mol}^{-1}$) of 200 to 290 in an amount of 0.05 to 40 g per liter of water. This low-temperature dyeing additive for protein fiber products serves to relax the higher-order structures of the protein fibers before dyeing or during dyeing, to thereby swell the fibers, thus rendering the fibers readily dyeable without detriment to the properties thereof.

2 Claims, 1 Drawing Sheet

LOW-TEMPERATURE DYEING ADDITIVE FOR PROTEIN FIBER PRODUCTS AND DYEING METHOD USING THE SAME

TECHNICAL FIELD

This invention relates to a low-temperature dyeing additive for protein fiber products made from wool, silk, etc. and a dyeing method using the same. More specifically, it relates to a low-temperature dyeing additive which is capable of dyeing protein fiber products at a temperature of not more than 90° C. and a dyeing method using the same.

BACKGROUND ART

Heretofore, dyeing of this kinds of protein fiber products is generally carried out in an acidic dyeing bath at a boiling temperature. Thus, various troubles such as yellowing, shrinkage, lowering in strength of protein fiber, and difficulty in color matching due to yellowing, and the like are generated. Accordingly, the conventional protein fiber dyeing technique is not necessarily optimum in view of obtaining protein fiber products with high quality, high added value and low energy cost.

On the other hand, in order to solve these problems, there have been investigated a low-temperature dyeing method comprising an easily dyeing treatment of protein fiber such as an ammonia pre-treatment, an enzyme pre-treatment, a 1-propanol treatment, an alkaline agent treatment, etc.

However, these dyeing method at a low-temperature has not yet been practically used by the reasons as mentioned below. That is, whereas the ammonia pre-treatment has been admitted to as effective for obtaining an easily dyeing effect, various problems related to its volatility and irritating odor have occurred. Also, the oxygen pre-treatment is effective for easy dyeing, but according to the present situation, it requires a high cost, and yet there involves problems that dyeing fastness of the resulting dyed material is likely low and a generation ratio of dyeing unevenness is high. Further, the 1-propanol treatment involves the problem that a uniform effect can be hardly obtained unless a large amount of a treating agent is used. Moreover, the alkaline agent treatment is effective for easy dyeing, but it involves the problem that a uniform effect cannot be obtained since the alkaline agent is too strong in a property as a donor.

An object of the present invention is to provide a low-temperature dyeing additive for protein fiber products, which serves to relax the high-order structures of the protein fibers before dyeing or during dyeing thereby swell the fibers without impairing physical properties thereof.

Another object of the present invention is to provide a method of dyeing protein fiber products with high quality and high dyeing density without impairing physical properties thereof after treating or while treating the protein fibers with the low-temperature dyeing additive.

DISCLOSURE OF THE INVENTION

In order to accomplish the above objects, a low-temperature dyeing additive which is the first embodiment of the present invention comprises a dyeing additive containing one or more solvents which are freely miscible with water and having a donor number within the range of 24 to 50 and an acceptor number within the range of 10 to 24 in the presence or absence of a surfactant, in an amount of 0.025 to 40 g per liter of water, and having a pH of 3.5 to 9.5.

The second low-temperature dyeing additive of the present invention comprises the first dyeing additive and 0.025 to 4.0 g of tributoxyethyl phosphate (hereinafter abbreviated to as "TBXP") per liter of water.

The third low-temperature dyeing additive of the present invention comprises the first dyeing additive and 0.05 to 40 g of at least one kind of anion having an enthalpy of hydration ($-\Delta H_{KJ\cdot mol}^{-1}$) of 200 to 290 per liter of water.

The fourth low-temperature dyeing additive of the present invention comprises the first dyeing additive, 0.025 to 4.0 g of TBXP per liter of water and 0.05 to 40 g of one or more anions having an enthalpy of hydration ($-\Delta H_{KJ\cdot mol}^{-1}$) of 200 to 290 per liter of water.

The present invention will be explained in detail below.

(a) Protein fiber products

The protein fiber products of the present invention are animal hair fiber such as wool, cashmere, alpaca, etc., cocoon fiber obtained from cocoons of raised silkworm, wild silkworm, etc. or wool, silk made of these fibers, or fabric, knitting and nonwoven fabric made from these fibers or yarn.

(b) Solvent

The solvent of the present invention is a solvent which is freely miscible with water and having a donor number within the range of 24 to 50 and an acceptor number within the range of 10 to 24. Examples of such a solvent may include dimethylformamide, N-methylpyrrolidone, N-dimethylacetamide, dimethylsulfoxide (hereinafter referred to as "DMSO"), N-diethylacetamide, N-methylmorpholine (hereinafter referred to as "N-NM"), pyridine, hexamethylphosphoric triamide, etc. If the donor number is less than 24, relaxation of a hydrogen bond of a protein fiber is insufficient. Contribution of the hydrogen bond is markedly large for the higher order structure of the protein fiber, so that it is necessary for the solvent to have a donor number of 24 or more to cut the hydrogen bond of the protein fiber and to solvate the protein fiber to the solvent whereby promoting diffusion and permeation of a dye therein. However, if the donor number exceeds 50, it is advantageous to cut the hydrogen bond but fixation of a dye is rather prevented. Also, if the acceptor number is less than 10, dyeing and fixation are too fast whereby uniform dyeing is impaired. If it exceeds 24, its proton donating property is too strong whereby a high effect of the donor number is decreased so that diffusion and permeation of a dye becomes rather insufficient.

The concentration of the solvent to be used is suitable 0.025 g or higher per liter of water and a high concentration gives a higher effect, but in view of an economical standpoint, the upper limit is suitably 40 g. However, in a solvent which itself shows an alkaline property, at a pH of 9.5 or higher, bad effects are exerted in a dyeing behavior and physical properties are lowered to that the maximum concentration to be used is determined within the range not exceeding a pH of 9.5. In view of dyeing performance, the lower limit of the pH is 3.5.

(c) TBXP

Heretofore, TBXP which is difficultly soluble in water is made soluble in water only by an emulsifier and a lower alcohol soluble in water so that there is a problem that a separation phenomenon is generated in a markedly diluted solution. To the contrary, in the present invention, it can be made self-emulsifiable without causing such problems by existing a glycol ether which is soluble in water.

Examples of water-soluble glycol ethers may include ethylene glycol monomethyl ether, diethylene glycol monomethyl ether, diethylene glycol monobutyl ether, etc.

The concentration of the TBXP to be used is suitably 0.025 g or more per liter of water, and a high concentration gives a higher effect, but in view of an economical standpoint, the upper limit is suitably 4.0 g.

(d) Anion having a enthalpy of hydration ($-\Delta H_{KJ\cdot mol}^{-1}$) of 200 to 290 per liter of water.

Examples of anions having a enthalpy of hydration ($-\Delta H_{KJ\cdot mol}^{-1}$) of 200 to 290 may include anions of salts ($SCN^-$, $ClO_4^-$) such as potassium thiocyanate, sodium thiocyanate, sodium perchlorate, etc. The concentration of the anions to be used is 0.05 g per liter of water as a minimum value and a high concentration gives a higher effect, but in view of an economical standpoint, the upper limit is suitably 40 g.

(e) Surfactant

The low-temperature dyeing additive of the present invention is not necessarily required to contain a surfactant, but in view of permeating the additive to the protein fiber products rapidly, it is preferably contained. Examples of the surfactant may include nonionic surfactants such as ethylene oxide adducts of lauryl alcohol (added molar number: 3 to 6), etc., and anionic surfactants such as alkylsulfosuccinate, etc. These surfactants may be used singly or in combination. The concentration of the surfactant to be used is preferably 2 g or less per liter of water.

(f) Treatment with the low-temperature dyeing additive and dyeing method.

In the treatment with the low-temperature dyeing additive for the protein fiber products of the present invention and the dyeing method of the treated protein fiber products, either methods of a two-bath method, a one-bath method or a simultaneous same-bath method may be used, and readily dyeable effect can be sufficiently accomplished. Among them, the one-bath method or the simultaneous same-bath method is preferred in view of economical standpoint and reproducibility.

In the case of the two-bath method, a processing temperature is 40° to 60° C. and a processing time at the temperature is desirably 15 to 45 minutes. In the case of the one-bath method, a processing temperature is 40° to 60° C. which is the initiating temperature at dyeing, and a processing time at the temperature is preferably 5 to 30 minutes. Further, in the case of the simultaneous same-bath method, a processing initiating temperature is 35° to 40° C., and a processing time is preferably an elevating time until a dyeing temperature of 70° to 90° C.

After the readily dyeable treatment of the protein fiber products, the fiber products may be subjected to dyeing by the conventional protein fiber dyeing method, but they may be subjected to dyeing at a higher pH than the conventional method. By subjecting to the dyeing at the higher pH, physical properties of the protein fiber products can be retained.

In the two-bath method, the protein fiber products are processed with the low-temperature dyeing additive in the first bath, and then the protein fiber products are dyed in the next bath. The first processing solution is simply removed as a waste solution and washing with water of the protein fiber products is not necessary. To wash the protein fiber products with water is not necessary since it decreases dyeing effects. After removing the first processing solution, a fresh solution which is capable of dyeing the protein fiber products is prepared.

On the other hand, in the one-bath method, after completion of a readily dyeing treatment and after adding a dyeing solution containing a dye, an acid with a calculated amount which is suitable for acidification necessary for dyeing the protein fiber products is added to carry out dyeing, or an acid with a calculated amount which is suitable for acidification necessary for dyeing is added by dividing several times until completion of raising the temperature.

Further, in the simultaneous same-bath method, it is preferred to add an acid with a calculated amount which is necessary for acidifying a dye for dyeing the protein fiber products is added by dividing to several portions after 5 minutes from initiating the processing and until completion of raising the temperature. This is one of the characteristic features of the dyeing method of the present invention.

After treating with the low-temperature dyeing additive of the present invention, or dyeing is carried out while effecting the treatment, the higher-order structures of the protein fibers relax due to the above solvent, TBXP, anion, etc., whereby resistance to absorbing the dye is lowered to become readily dyeable. That is, the solvent promotes diffusion and permeation of the dye by cutting hydrogen bonds of the protein fibers or increasing affinity of the protein fibers to the solvent, but the amount is too much, there is a risk of destroying the higher-order structures accompanied by dissolution of tissues. Accordingly, in order to make the amount of the solvent to be used as little as possible and to promote fixation of the dye, it is effective to add an anion having an enthalpy of hydration ($-\Delta H_{KJ\cdot mol}^{-1}$) of 200 to 290. If the enthalpy of hydration ($-\Delta H_{KJ\cdot mol}^{-1}$) is less than 200, cutting action against hydrogen bonds is little, while if it exceeds 290, fixation of the dye is hindered. Also, TBXP selectively shows affinity to a specific portion of a higher-order structures of protein fibers such as a β phase of C.M.C of wool fiber and, by permeating and swelling, promotes formation of an inner passage in protein for a dye. At this time, the low-temperature dyeing additive of the present invention maximally relaxes the higher-order structures of the protein fiber and does not destroy the higher-order structures. Thus, when the treated protein fiber products are dried, the higher-order structures are reconstituted. Therefore, there is little effect on the physical properties on the protein fiber and dyeing fastness is also good.

According to the dyeing method of the present invention, as compared with the conventional boiling dyeing, low-temperature and short time dyeing of protein fibers are realized. This means that physical properties of the protein fibers are not lowered, yellowing of the same is prevented to simplify the color matching operation and to decrease a percentage of rejects of color matching.

A dye which is dyed under a strongly acidic condition in the conventional and usual dyeing method is dyeable under a moderate acidic condition in the dyeing method of the present invention. This means that low-temperature dyeing is realized as well as deterioration of physical properties such as yellowing, shrinkage, decrease in strength of the protein fibers can be prevented.

When a high density dyeing is to be carried out, such a dye is incomplete in dissolution in a dyeing bath in the conventional method so that unevenness of dyeing is easily generated whereby a tendency of lowering in dyeing fastness is observed. This problem can be overcome in the dyeing method of the present invention.

Also, dyeing fastness of the protein fiber products subjected to low-temperature dyeing according to the dyeing method of the present invention is the same or more as compared with protein fiber products obtained by subjected to boiling dyeing by the conventional strongly acidic dyeing bath.

Further, in the fiber products obtained by low-temperature dyeing, yellowing of protein fiber is little so that the fiber shows a color hue inherently possessed by the dye and excellent color sharpness.

BEST MODE FOR CARRYING OUT THE INVENTION

Figure 1:
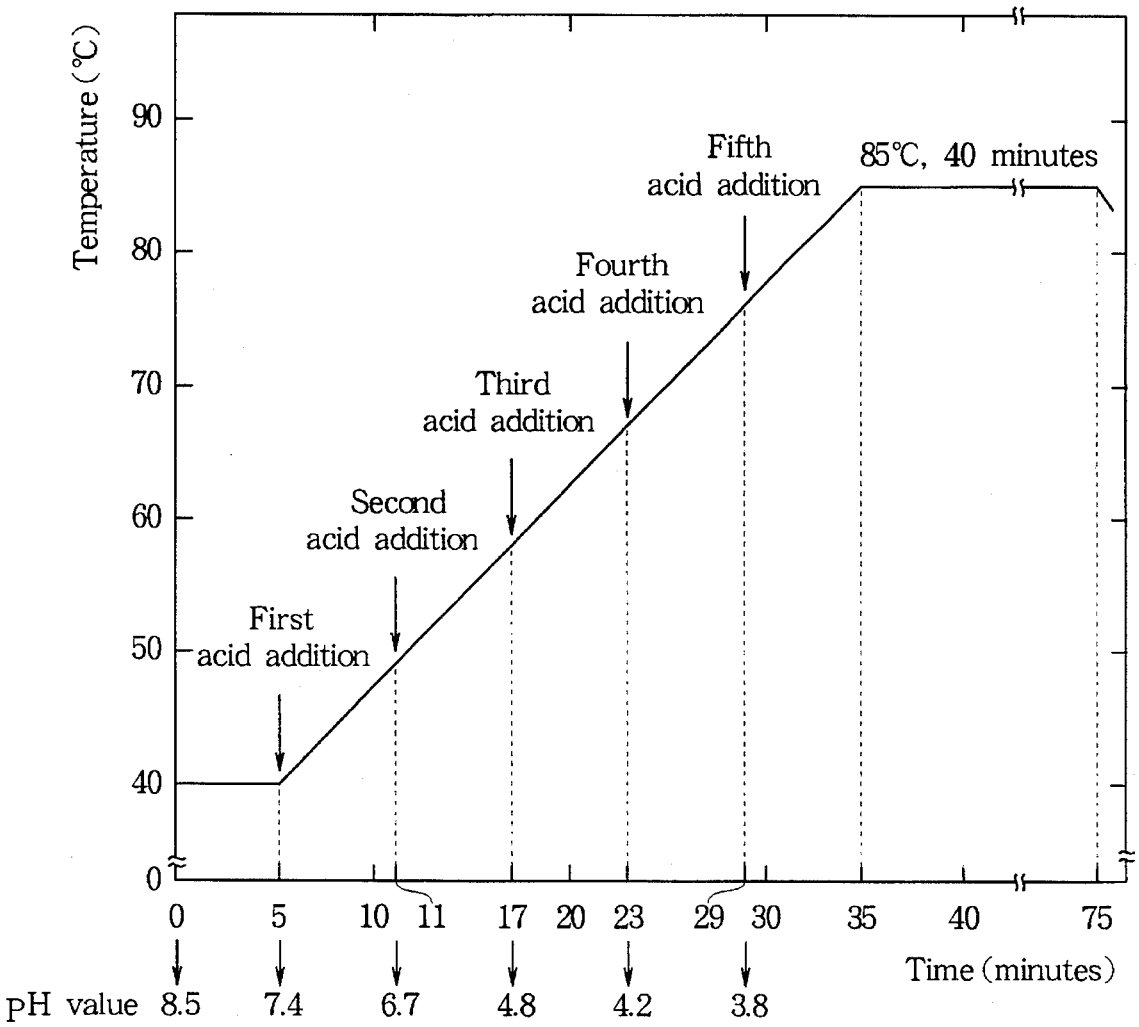
FIG. 1 is a drawing showing a dyeing situation in Example of the present invention.

Next, examples of the present invention are explained with Comparative example. Examples herein mentioned are not to be construed as limiting the technical range of the present invention.

<Preparation of raw solution, etc.>

① Preparation of a raw solution No. 1 for the first low-temperature dyeing additive.

A solvent of DMSO (produced by ASAHI CHEMICAL CO., LTD.) with a ratio of 250 g per liter of water was dissolved to prepare an aqueous solution (hereinafter referred to as $DMSO_{25}$). The aqueous solution is hereafter referred to as raw solution No. 1.

② Preparation of a raw solution No. 2 for the first low-temperature dyeing additive.

250 g of solvent N-MM (produced by KISHIDA CHEMICAL CO., LTD.) was dissolved in one liter of water to prepare an aqueous solution ($N\text{-}MM_{25}$) which is hereinafter referred to as raw solution No. 2.

③ Preparation of a TBXP self emulsified solution for the second low-temperature dyeing additive.

20% by weight of TBXP, 40% by weight of methanol, 7% by weight of diethylene glycol monomethyl ether, 7% by weight of polyoxyethylenephenyl ether where added mole of 20 and 26% by weight of water were uniformly mixed to prepare a TBXP self-emulsified solution (hereinafter called to as $TBXP_S$).

④ Preparation of anion solution No. 1 for the third low-temperature dyeing additive.

An anion of $SCN^-$ (an enthalpy of hydration ($-\Delta H_{KJ\cdot mol^{-1}}$) of 290) of ammonium triocyanate (produced by NIHON KAGAKU SAN-GYO CO., LTD.) was mixed with one liter of water with a ratio of 250 g to prepare an anion solution No. 1 (hereinafter called to as $NH_4SCN_{25}$).

⑤ Preparation of anion solution No. 2 for the third low-temperature dyeing additive.

An anion of $ClO_4^-$ (an enthalpy of hydration ($-\Delta H_{KJ\cdot mol^{-1}}$) of 200) of sodium perchlorate (anhydride) (produced by KISHIDA CHEMICAL CO., LTD.) was mixed with one liter of water with a ratio of 250 g to prepare an anion solution No. 2 (hereinafter called to as $NaClO_{4-25}$).

⑥ Preparation of a surfactant

One liter of water was mixed with 300 g dioctyl-sulfo-sodium succinate, 50 g of diethylene glycol dimethyl ether and 50 g of isopropanol to prepare a surfactant. This surfactant is hereinafter referred to as $DSA_6$.

EXAMPLES 1 to 19

A low-temperature dyeing treatment and dyeing were carried out with a two bath method. That is, plain fabrics muslin woolen cloth with the woof of No. 1/60 meter×14/cm and the warp of No. 1/60 meter×14/cm was prepared. In a minicolor dyeing tester (manufactured by TEXAM CO., LTD.), the woolen cloth and a low-temperature dyeing additive with a prescription as shown in Table 1 below with a bath ratio of 1:25 were charged and treated at 40° C. for 30 minutes.

Next, 1% owf of a leveling acidic dye (Telon Blue K BRILL) was collected, and the treated solution was discharged from the dyeing tester. Thereafter, the treated woolen cloth and water dyeing tester. Thereafter the above dye and formic acid were dissolved in water and the fabric was treated therein at a bath ratio of 1:25, and the temperature of the mixture was raised from 40° C. to 85° C. at a rate of 1.5° C./minute. The fabric was dyed at 85° C. for 40 minutes to adsorb the dye. After dyeing, the woolen cloth was taken out from the dyeing tester, washed with water and dried to obtain a uniform blue colored cloth. When the pH of the residual bath was measured by pH. Meter.F.8E (manufactured by HORIBA LTD.) to obtain a value as shown in Table 1.

Further, by using Ubest-30 Type Spectrophotometer (manufactured by JAPAN SPECTROSCOPIC CO., LTD.), an absorbance (hereinafter called to as DEH-1) of the first bath dyeing solution and an absorbance (hereinafter called to as DEH-2) of the dyeing solution after completion of dyeing were measured, respectively, and a dye absorption ratio (hereinafter called to as DEH) was measured by the following equation to obtain the value shown in Table 1.

$$\text{Dye absorption ratio (\%)}=\{(DEH\text{-}1-DEH\text{-}2)/DEH\text{-}1\}\times 100$$

TABLE 1

| | $DMSO_{25}$ (g/l) | $N\text{-}MM_{25}$ (g/l) | $TBXP_s$ (g/l) | $NH_4SCN_{25}$ (g/l) | $NaClO_{4-25}$ (g/l) | $DSA_6$ (g/l) | DEH (%) | pH |
|---|---|---|---|---|---|---|---|---|
| Example 1 | 0.1 | — | — | — | — | 3.0 | 99 | 4.0 |
| Example 2 | 3.0 | — | — | — | — | 3.0 | 99 | 4.0 |
| Example 3 | — | 0.1 | — | — | — | 3.0 | 99 | 4.0 |
| Example 4 | — | 3.0 | — | — | — | 3.0 | 99 | 4.0 |
| Example 5 | — | 10.0 | — | — | — | 3.0 | 99 | 4.0 |
| Example 6 | 1.5 | — | 1.3 | — | — | 3.0 | 99 | 4.2 |
| Example 7 | — | 2.0 | 1.3 | — | — | 3.0 | 99 | 4.2 |
| Example 8 | 1.5 | 2.0 | — | — | — | 3.0 | 99 | 4.2 |
| Example 9 | 1.5 | — | — | 1.0 | — | 3.0 | 99 | 4.2 |
| Example 10 | 1.5 | — | — | — | 1.0 | 3.0 | 99 | 4.2 |
| Example 11 | 1.5 | 2.0 | 1.3 | — | — | 3.0 | 99 | 4.2 |
| Example 12 | 1.5 | — | 1.3 | 1.0 | — | 3.0 | 99 | 4.2 |
| Example 13 | 1.5 | — | 1.3 | — | 1.0 | 3.0 | 99 | 4.2 |
| Example 14 | — | 2.0 | 1.3 | 1.0 | — | 3.0 | 99 | 4.2 |
| Example 15 | — | 2.0 | 1.3 | — | 1.0 | 3.0 | 99 | 4.2 |
| Example 16 | 1.5 | 2.0 | — | 1.0 | — | 3.0 | 99 | 4.2 |
| Example 17 | 1.5 | 2.0 | — | — | 1.0 | 3.0 | 99 | 4.2 |
| Example 18 | 1.5 | 2.0 | 1.3 | 1.0 | — | 3.0 | 99 | 4.2 |
| Example 19 | 1.5 | 2.0 | 1.3 | — | 1.0 | 3.0 | 99 | 4.2 |

To the contrary, DEH of non-treated muslin woolen cloth which did not treat with the low-temperature dyeing additive of the present invention was 85%. Also, when the same muslin woolen cloth as the muslin woolen cloth used in Examples 1 to 19 was subjected to boiling dyeing at a pH of the sulfuric acid-acidic bath of 2.5 at 100° C. for 60 minutes and friction fastness, washing fastness, sweat fastness and light-resistant fastness of the muslin woolen cloth dyed in Examples 1 to 19 and those of the muslin woolen cloth subjected to boiling dyeing were compared to each other, respectively. The results are that respective fastnesses of the muslin woolen clothes dyed in Examples 1 to 19 were the same with those of muslin clothes subjected to boiling dyeing.

EXAMPLES 20 to 38

Low-temperature dyeing treatment and dyeing were carried out by the one bath method. That is, the same muslin woolen clothes as the muslin woolen clothes used in Examples 1 to 19 were treated with the low-temperature dyeing additives having prescriptions shown in Table 1 in the same manner as in Examples 1 to 19. Without discharging this treating solution from the dyeing tester, the same dye as in Examples 1 to 19 and formic acid were added to the treating solution to make the dyeing bath pH 3.8, dyeing is carried out in the same manner as in Examples 1 to 19 to obtain uniform blue colored dyeing clothes. DEH of the remaining bath was 98.5% or more and a pH of the remaining bath was 4.2. Fastness of the muslin woolen clothes according to the dyeing method are the same with those of Examples 1 to 19.

EXAMPLE 39

Low-temperature dyeing treatment and dyeing were carried out by the simultaneous same-bath method. That is, after charging the low-temperature dyeing additive having a prescription shown in Table 2 and the same dye as in Examples 1 to 19 in a dyeing tester, the same muslin woolen cloth as the muslin woolen clothes used in Examples 1 to 19 was also charged in the dyeing tester and swelled sufficiently in a dyeing solution at 40° C. for 5 minutes. Then, the temperature was raised from 40° C. to 85° C. at a rate of 1.5° C./minute, and during the temperature raising, formic acid was added to the dyeing solution dividing into 5 times. Dyeing was carried out at 85° C. for 40 minutes to adsorb the dye. The situation is shown in FIG. 1.

After dyeing, woolen cloth was taken out from the dyeing tester, washed with water and dried to obtain a uniformly blue colored cloth. DEH of the remaining bath was 98.5% or more and a pH of the remaining bath was 4.2. Friction fastness, washing fastness, sweat fastness and light-resistant fastness of the muslin woolen cloth dyed by this dyeing method were not less than the respective fastness of muslin woolen cloth subjected to boiling dyeing at a pH of the sulfuric acid-acidic bath of 2.5 at 100° C. for 60 minutes.

TABLE 2

| | $DMSO_{25}$ (g/l) | $N\text{-}MM_{25}$ (g/l) | $TBXP_s$ (g/l) | $NH_4SCN_{25}$ (g/l) | $NaClO_{4\text{-}25}$ (g/l) | $DSA_6$ (g/l) | DEH (%) | pH |
|---|---|---|---|---|---|---|---|---|
| Example 39 | 1.5 | 2.0 | 1.25 | 1.0 | 1.0 | 3.0 | 98.5 | 4.2 |

EXAMPLES 40 TO 78

In the same manner as in Examples 1 to 39 except for changing the dye used in Examples 1 to 39 to a chromium dye (C.I. Mordant Black), adding the dye with 3% owf, and after adsorbing the dye at 85° C. for 40 minutes, 0.6% owf of sodium bichromate was added thereto, and further subjecting to chromating treatment at 85° C. for 40 minutes, muslin woolen clothes dyed to a uniform black color were obtained. DEH of the remaining bath immediately before addition of sodium bichromate was 95.4% and a pH of the acidic bath was 4.2. Friction fastness, washing fastness, sweat fastness and light-resistant fastness of these muslin woolen clothes were completely the same with the respective fastness of muslin woolen cloth subjected to boiling dyeing at 97° C. for 60 minutes.

As described above, according to the low-temperature dyeing additive for the protein fiber products of the present invention, there are characteristics that it serves to relax the higher-order structures of the protein fibers before dyeing or during dyeing and swelling the fiber without impairing the excellent properties possessed by the protein fiber. By subjecting to dyeing at a relatively low temperature within a short time by using the low-temperature dyeing additive, protein fiber products can be dyed with good reproducibility without impairing the physical properties thereof with a low dyeing cost and a high dyeing density.

As the results, various problems such as yellowing, shrinkage and lowering in strength of protein fibers or difficulty in color matching which are problems involved in the conventional acidic boiling dyeing method of protein fiber products, or various problems involved in readily dyeing due to an ammonia pre-treatment or an enzyme pre-treatment or readily dyeing due to a 1-propanol treatment or an alkaline agent treatment can be solved at a stroke. Thus, protein fiber products having high quality and high added value can be produced readily with low energy.

Particularly, introduction of a low-temperature and short time dyeing method according to the present invention leads to energy reduction in dyeing processing, and a dye adsorbing ratio is extremely high so that a degree of pollution due to a dyeing solution discharged is low which contribute to prevent worsening the earth environment.

INDUSTRIAL APPLICABILITY

The low-temperature dyeing additive of the protein fiber products of the present invention is available for readily dyeing without impairing physical properties of fibers.

I claim:

1. A low-temperature dyeing additive for protein fiber products which comprises one or more kinds of solvents selected from the group consisting of dimethylformamide, N-methylpyrrolidone, N-dimethylacetamide, dimethylsulfoxide, N-diethylacetamide, N-methylmorpholine, pyridine, and hexamethylphosphoric triamide which are freely miscible with water and having a donor number within the range of 24 to 50 and an acceptor number within the range of 10 to 24 in the presence or absence of a surfactant, in amount of 0.025 to 40 g per liter of water, and at least one anion selected from the group consisting of thiocyanates and perchlorates having an enthalpy of hydration ($-\Delta H_{KJ\cdot mol}^{-1}$) of 200 to 290 in amount of 0.05 to 40 g per liter of water, said additive having a pH of 3.5 to 9.5.

2. A low-temperature dyeing additive for protein fiber product which comprises a) one or more kinds of solvents selected from the group consisting of dimethylformamide, N-methylpyrrolidone, N-dimethylacetamide, dimethylsulfoxide, N-diethylacetamide, N-methylmorpholine, pyridine, and hexamethylphosphoric triamide which are freely miscible with water and having a donor number within the range of 24 to 50 and an acceptor number within the range of 10 to 24 in the presence or absence of a surfactant, in an amount of 0.025 to 40 g per liter of water, b) tributoxyethyl phosphate in amount of 0.025 to 4.0 g per liter of water, c) at least one anion selected from the group consisting of thiocyanates and perchlorates having an enthalpy of hydration ($-\Delta H_{KJ \cdot mol}^{-1}$) of 200 to 290 in an amount of 0.05 to 40 g per liter of water, said additive having a pH of 3.5 to 9.5.

* * * * *